US010872544B2

(12) United States Patent
Lin et al.

(10) Patent No.: US 10,872,544 B2
(45) Date of Patent: Dec. 22, 2020

(54) DEMURA SYSTEM FOR NON-PLANAR SCREEN

(71) Applicant: ACER INCORPORATED, New Taipei (TW)

(72) Inventors: Jia-Yu Lin, New Taipei (TW); Chih-Chiang Chen, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 251 days.

(21) Appl. No.: 16/100,178

(22) Filed: Aug. 9, 2018

(65) Prior Publication Data

US 2019/0371219 A1 Dec. 5, 2019

(30) Foreign Application Priority Data

Jun. 4, 2018 (TW) ..... 107119186 A

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 2300/0809* (2013.01)

(58) Field of Classification Search
None
See application file for complete search history.

(56) References Cited

U.S. PATENT DOCUMENTS 10,276,083 B2 * 4/2019 Zhang ..... G09G 3/006
2008/0129894 A1 * 6/2008 Kang ..... H04N 9/3185 348/758
2011/0019056 A1 1/2011 Hirsch
2016/0154926 A1 * 6/2016 Szigeti ..... G06T 7/32 703/8
2016/0196794 A1 * 7/2016 Kim ..... G09G 3/3611 345/690
2017/0108988 A1 * 4/2017 Kim ..... G06F 3/0421
2017/0359573 A1 * 12/2017 Kim ..... H04N 5/2256
2018/0122284 A1 * 5/2018 Zhang ..... G09G 3/2007

(Continued)

FOREIGN PATENT DOCUMENTS

CN 101521745 A 9/2009
CN 101919235 A 12/2010

(Continued)

*Primary Examiner* — Cynthia Segura
(74) *Attorney, Agent, or Firm* — Winston Hsu

(57) ABSTRACT

A Demura system includes a camera module, a distance detection module, a location calibration module and a processing circuit. The camera module is configured to capture images displayed on a non-planar screen during an image-capturing period. The distance detection module is configured to detect the distance between the camera module and the non-planar screen during a test period. The location calibration module is configured to carry the camera module and the distance detection module, adjust the angle of the distance detection module, adjust the angle of the camera module and adjust the location of the camera module. The processing circuit is configured to control the location calibration module according to the data acquired by the distance detection module during the test period so as to move the camera module to a predetermined location.

16 Claims, 13 Drawing Sheets

(56) References Cited

U.S. PATENT DOCUMENTS

| | | | | |
|---|---|---|---|---|
| 2019/0041420 | A1* | 2/2019 | Zhong | G01P 3/38 |
| 2019/0353896 | A1* | 11/2019 | Kim | G02B 6/0065 |
| 2020/0045276 | A1* | 2/2020 | Hsiao | G06T 3/005 |
| 2020/0175661 | A1* | 6/2020 | Hu | H04M 1/0268 |
| 2020/0211429 | A1* | 7/2020 | Kim | G09G 3/006 |

FOREIGN PATENT DOCUMENTS

| | | | |
|---|---|---|---|
| CN | 103686105 | A | 3/2014 |
| CN | 105165002 | A | 12/2015 |
| CN | 105244007 | A | 1/2016 |
| CN | 105590604 | A | 5/2016 |
| CN | 106782429 | A | 5/2017 |
| CN | 107024485 | A | 8/2017 |
| CN | 107086021 | A | 8/2017 |
| CN | 107749284 | A | 3/2018 |
| CN | 108091288 | A | 5/2018 |
| CN | 111147742 | A | 5/2020 |
| WO | 2018/048107 | A1 | 3/2018 |

* cited by examiner

DEMURA SYSTEM FOR NON-PLANAR SCREEN

CROSS REFERENCE TO RELATED APPLICATION

This application claims priority of Taiwan Application No. 107119186 filed on 2018 Jun. 4.

BACKGROUND OF THE INVENTION

1. Field of the Invention

The present invention is related to a Demura system, and more particular, to a Demura system for a non-planar screen.

2. Description of the Prior Art

Mura is a visual problem which appears on displays as regions of low contrast and non-uniform brightness in various shapes and sizes. The irregular pattern or region causes uneven screen uniformity and influences viewer experience.

There are many manifestations of the Mura condition and the causes are quite diverse. Several possible causes of Mura include manufacturing defects and non-uniform luminance distribution of the backlight. In a prior art correction method of Mura (commonly known as Demura), a specific image is input to the display panel and a camera is used to capture the screen image under various gray scale conditions. By analyzing the non-uniformity in brightness or contrast based on the acquired optical information, an algorithm may be implemented for compensating Mura by adjusting the luminance and the chromaticity of each pixel to produce images with an entirely uniform appearance. In order to tackle insufficient resolution of cameras or Moiré pattern, a panoramic photography technique may be adopted in which the location of a camera changes in a predefined pattern so as to capture partial images of a screen section by section and then composite the partial images for subsequent Mura analysis.

Non-planar screens (also known as curved screens) provide more immersive visual experience than planar screens. When applying a prior art Demura method on a non-planar screen, several problems may occur when the camera captures partial images at different locations. Since the distance between the camera and the non-planar screen changes as the camera moves in a predefined manner, the partial images displayed on different sections of the non-planar screen may have different brightness or distortions caused by different pixel angles, thereby requiring a complicated algorithm for compensating the errors when calculating the brightness of the composited image from the partial images. Therefore, there is a need for a Demura system for use in non-planar screen.

SUMMARY OF THE INVENTION

The present invention provides a Demura system which includes a camera, a distance detection module, a location calibration module, and a processing circuit. The camera module is configured to capture an image displayed on a non-planar screen during an image-capturing period. The distance detection module is configured to detect a distance between the camera module and the non-planar screen during a test period. The location calibration module is configured to carry the camera module and the distance detection module, adjust an angle of the distance detection module, adjust an angle of the camera module and adjust a location of the camera module. The processing circuit is configured to control the location calibration module according to data acquired by the distance detection module during the test period so as to move the camera module to a predetermined location.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
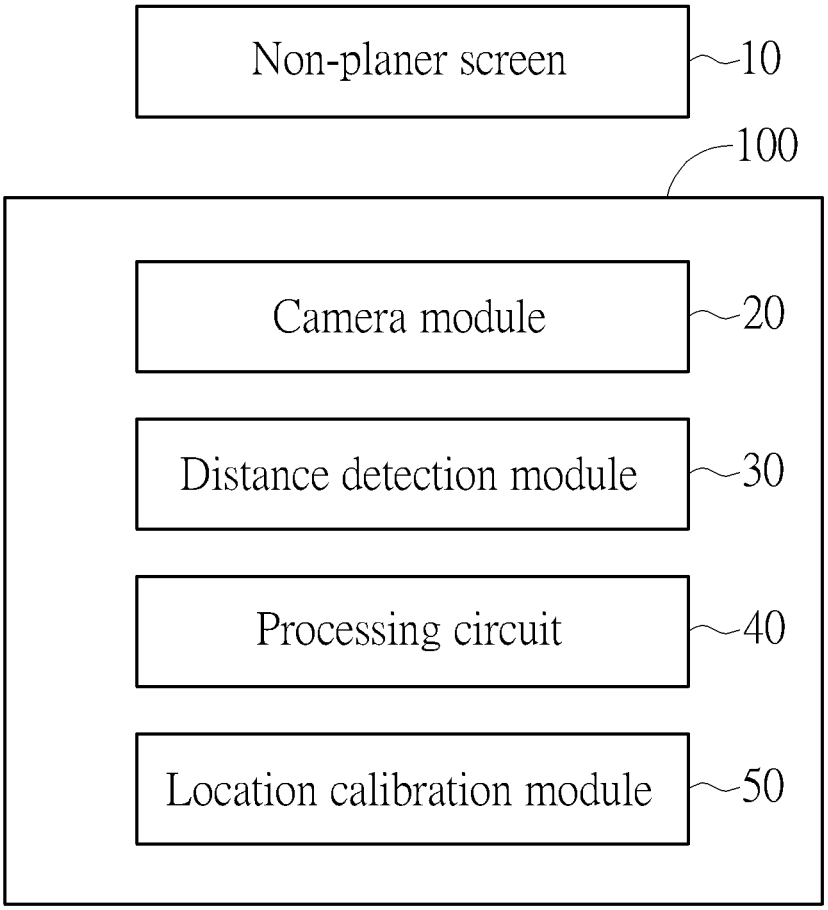
FIG. 1 is a functional diagram of a Demura system according to an embodiment of the present invention.

FIG. 1 is a functional diagram of a Demura system 100 according to an embodiment of the present invention. The Demura system 100 includes a camera module 20, a distance detection module 30, a processing circuit 40, and a location calibration module 50. The Demura system 100 may be implemented in a non-planer screen 10 which may be, but not limited to, a curved screen, a spherical screen, or an arc virtual reality (VR) screen. The camera module 20 includes one or multiple cameras, and the distance detection module 30 includes one or multiple proximity sensors. Each proximity sensor of the distance detection module 30 is disposed at a location associated with a corresponding camera of the camera module 20 for detecting the distance between the corresponding camera and the non-planar screen 10. For example, each proximity sensor may be disposed on a corresponding camera, or adjacent to a corresponding camera. The location calibration module 50 is configured to carry the camera module 20 and the distance detection module 30, adjust the angle of each camera in the camera module 20 so as to capture the image displayed on the non-planar screen 10 using a panoramic photography technique, and adjust the location of each camera in the camera module 20 according to the data acquired by the distance detection module 30.

Figure 2:
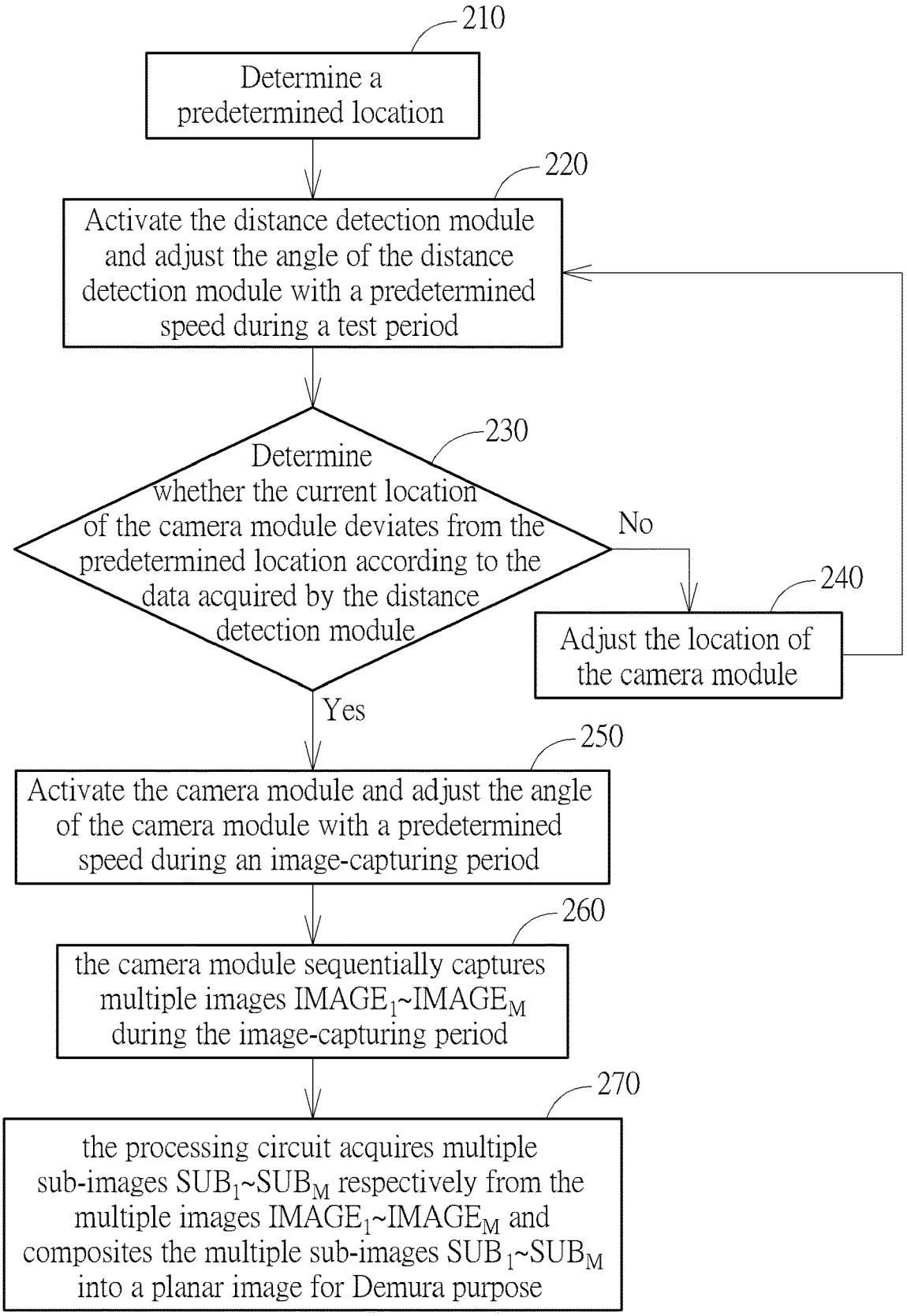
FIG. 2 is a flowchart illustrating the operation of a Demura system according to an embodiment of the present invention.

FIG. 2 is a flowchart illustrating the operation of the Demura system 100 according to an embodiment of the present invention. The flowchart in FIG. 2 includes the following steps:

Step 210: determine a predetermined location.

Step 220: activate the distance detection module 30 and adjust the angle of the distance detection module 30 with a predetermined speed during a test period.

Step 230: determine whether the current location of the camera module 20 deviates from the predetermined location according to the data acquired by the distance detection module 30.

Step 240: adjust the location of the camera module 20.

Step 250: activate the camera module 20 and adjust the angle of the camera module 20 with a predetermined speed during an image-capturing period.

Step 260: the camera module 20 sequentially captures multiple images $IMAGE_1$~$IMAGE_M$ during the image-capturing period.

Step 270: the processing circuit 40 acquires multiple sub-images $SUB_1$~$SUB_M$ respectively from the multiple images $IMAGE_1$~$IMAGE_M$ and composites the multiple sub-images $SUB_1$~$SUB_M$ into a planar image for Demura purpose.

Figure 3:
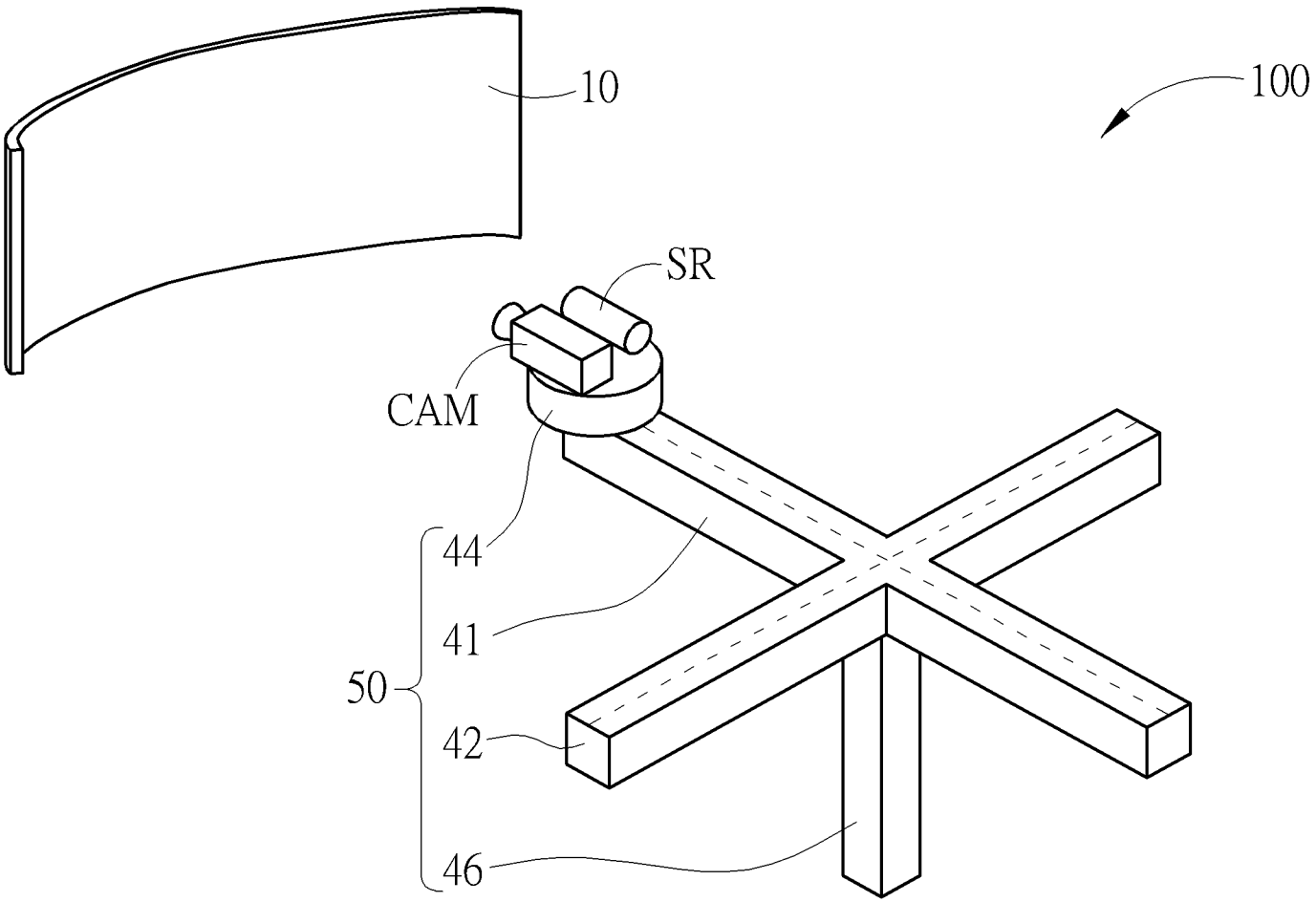
FIG. 3 is a diagram of a Demura system according to an embodiment of the present invention.

FIG. 3 is a diagram of the Demura system 100 according to an embodiment of the present invention. In this embodiment, the non-planar screen 10 is circular-shaped curved screen having a constant curvature. The camera module 20 includes a camera CAM, and the distance detection module 30 includes a proximity sensor SR which may be disposed on the camera CAM or adjacent to the camera CAM. The location calibration module 50 includes two slide guides 41 and 42, a swiveling base 44, and a pillar 46. The slide guides 41 and 42 provide two tracks perpendicular to each other (represented by dotted lines in FIG. 3), along which an object may move towards or away from the non-planar screen 10, or move from one end of the non-planar screen 20 to another end. The swiveling base 44, disposed on one end of the slide guide 41, is capable of rotating 360 degrees and moving along the track of the slide guides 41 and 42. The track of the slide guide 41 and the track of the slide guide 42 cross each other at an intersection point which may be fixed to the pillar 46. The height of the pillar 46 may be adjusted, such as using an electrical air pump. In the Demura system 100 depicted in FIG. 3, the camera CAM and the proximity sensor SR may be disposed on the swiveling base 44 of the location calibration module 50, and the processing circuit 40 (not shown in FIG. 3) may determine whether the current location of the camera CAM deviates from the predetermined location according to the data acquired by the proximity sensor SR, wherein the predetermined location is at a constant distance from the set of all points in the surface of the non-planar screen 10 (circular-shaped curved screen) which are at the same height of the predetermined location.

As well-known to those skilled in the art, PPI (pixel per inch) is a measurement of pixel density (the number of pixels printed in a one inch square area) of a planar screen, while PPD (pixel per degree) is a measurement of pixel density (the number of pixels per degree of the viewing) of a non-planar screen. In step 210, the distance between the predetermined location and the non-planar screen 10 may be determined based on the PPD specification of the Demura system 100, while the height of the predetermined location may be determined based on the vertical viewing range of the non-planar screen 10 or the camera module 20.

After determining the predetermined location, steps 220 and 230 are executed for performing a calibration operation on camera location. In step 220, the swiveling base 44 of the location calibration module 50 is rotated with a predetermined speed and in a predetermined direction during the test period so as to adjust the angle of the proximity sensor SR in the distance detection module 30. In step 230, the processing circuit 40 is configured to determine whether the current location of the camera CAM deviates from the predetermined location according to the data acquired by the proximity sensor SR.

Figure 4A:
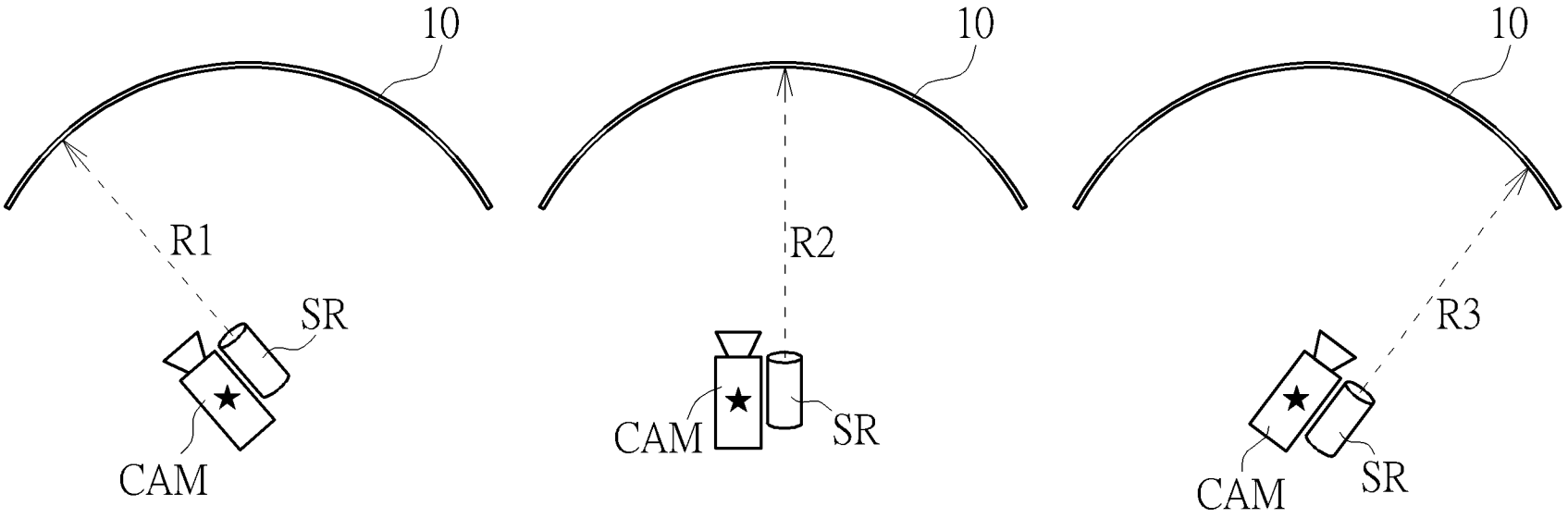
FIG. 4A is a diagram illustrating the operation of the Demura system when performing the calibration operation on camera location according to an embodiment of the present invention.
Figure 4B:
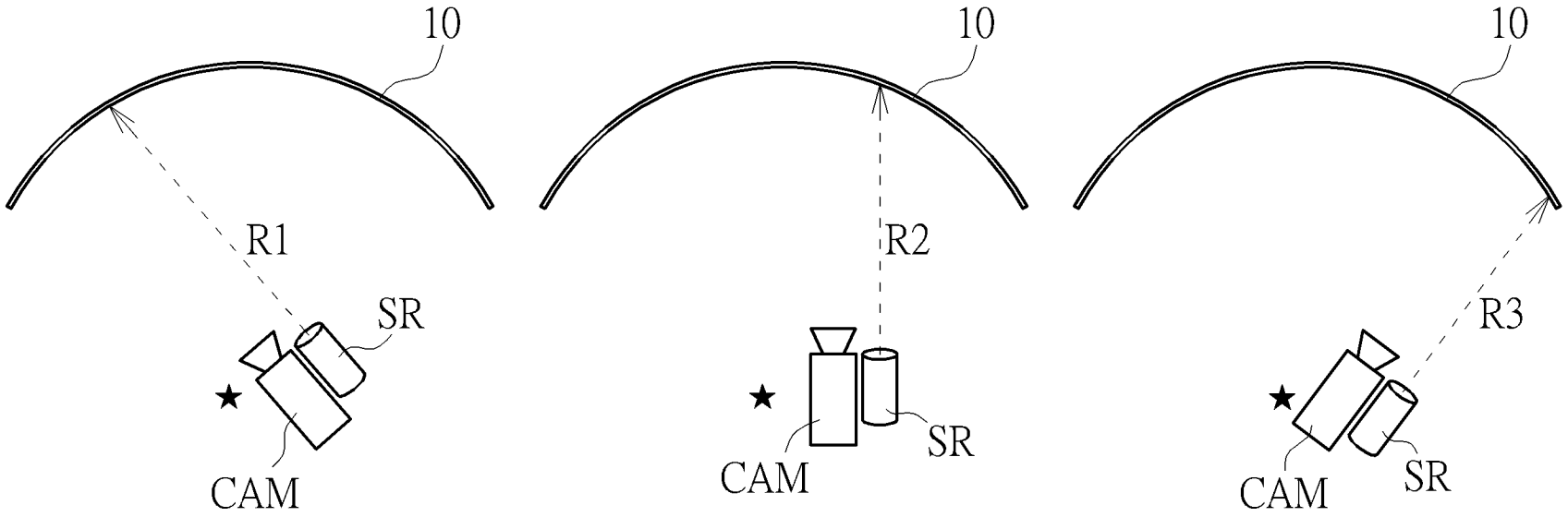
FIG. 4B is a diagram illustrating the operation of the Demura system when performing the calibration operation on camera location according to another embodiment of the present invention.
Figure 4C:
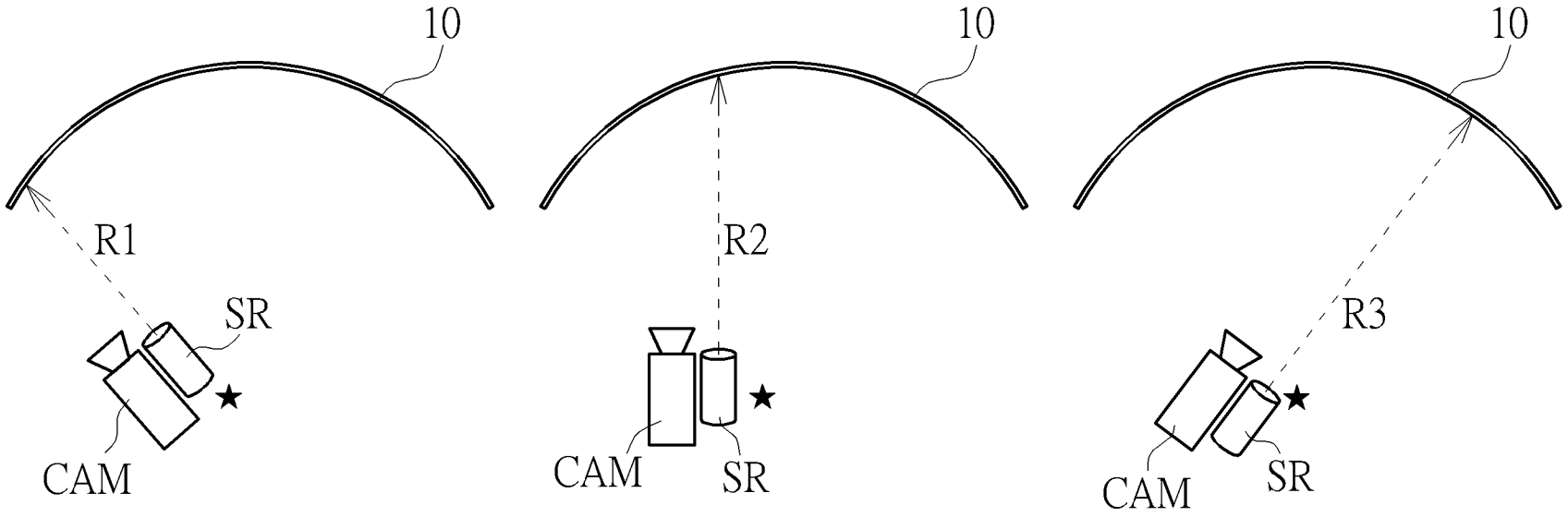
FIG. 4C is a diagram illustrating the operation of the Demura system when performing the calibration operation on camera location according to another embodiment of the present invention.

FIGS. 4A-4C are diagrams illustrating the operation of the Demura system 100 when performing the calibration operation on camera location according to embodiments of the present invention. For illustrative purpose, it is assumed that the proximity sensor SR detect the location of the camera SR 3 times during the test period, wherein R1~R3 represent the data associated with the distance between the camera CAM and the non-planar screen 10 and sequentially acquired by the proximity sensor SR during the test period. When the processing circuit 40 receives data indicating R1=R2=R3, it means the camera CAM is currently located at the predetermined location (represented by a star sign in FIG. 4A), as depicted in FIG. 4A. When the processing circuit 40 receives data indicating R1>R2>R3, it means the camera CAM is currently located to the right of the predetermined location (represented by a star sign in FIG. 4B), as depicted in FIG. 4B. When the processing circuit 40 receives data indicating R1<R2<R3, it means the camera CAM is currently located to the left of the predetermined location (represented by a star sign in FIG. 4C), as depicted in FIG. 4C.

When determining that the current location of the camera CAM deviates from the predetermined location according to the data acquired by the proximity sensor SR in step 230, the processing circuit 40 is configured to instruct the location calibration module 50 to adjust the location of the camera CAM in step 240. For example, the swiveling base 44 may move along the slide guides 41 and 42 in order to adjust the location of the camera CAM with respect to the non-planar screen 10. In an embodiment of the present invention, steps 220 and 230 may be executed repeatedly until the camera CAM of the camera module 20 arrives at the predetermined location.

When the processing circuit 40 determines that the camera CAM is currently located at the predetermined location according to the data acquired by the proximity sensor SR in step 230, the lens of the camera CAM may be maintained at the same distance from the set of all points in the surface of the non-planar screen 10 at the same height of the camera CAM when the angle of the camera CAM is adjusted by rotating the swiveling base 44. Under such circumstance, steps 250 and 260 are then executed for performing an image capturing operation. In step 250, the swiveling base 44 of the location calibration module 50 may rotate with a predetermined speed and in a predetermined direction in order to adjust the angle of the camera CAM in the camera module 20. In step 260, the camera CAM may sequentially capture multiple images $IMAGE_1$~$IMAGE_M$ during the image-capturing period, wherein M is an integer larger than 1.

Figure 5A:
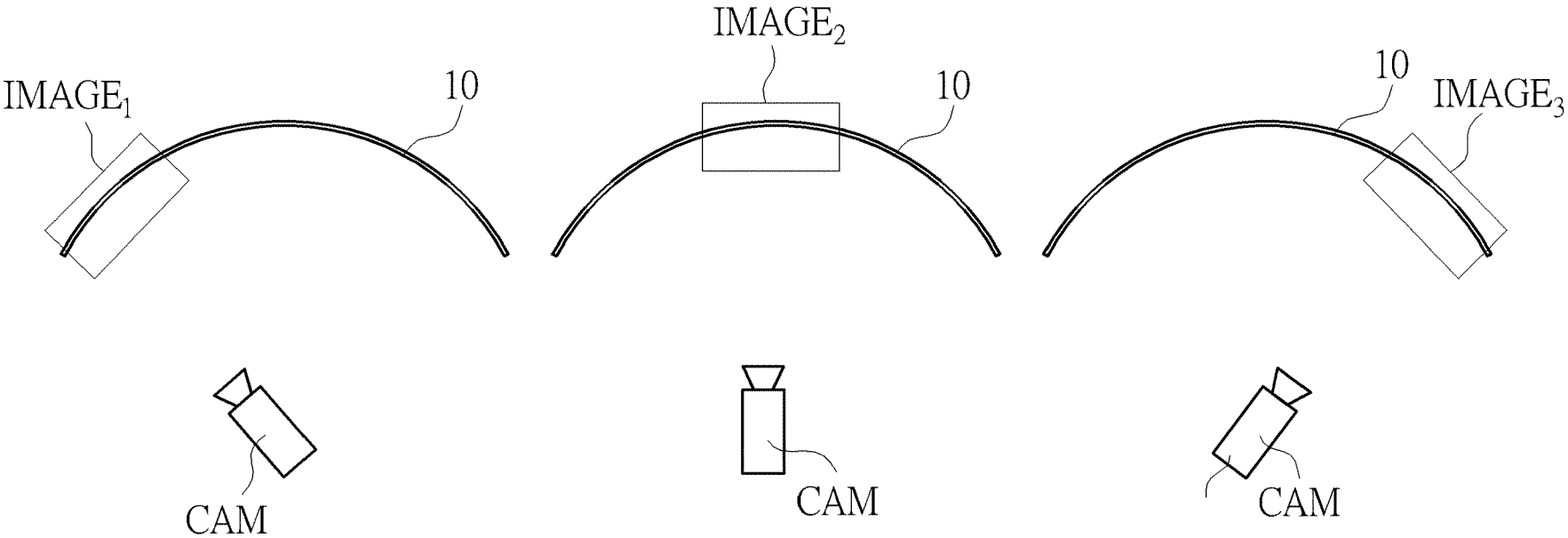
FIGS. 5A and 5B are diagrams illustrating the operation of a Demura system during the image-capturing period according to an embodiment of the present invention.
Figure 5B:
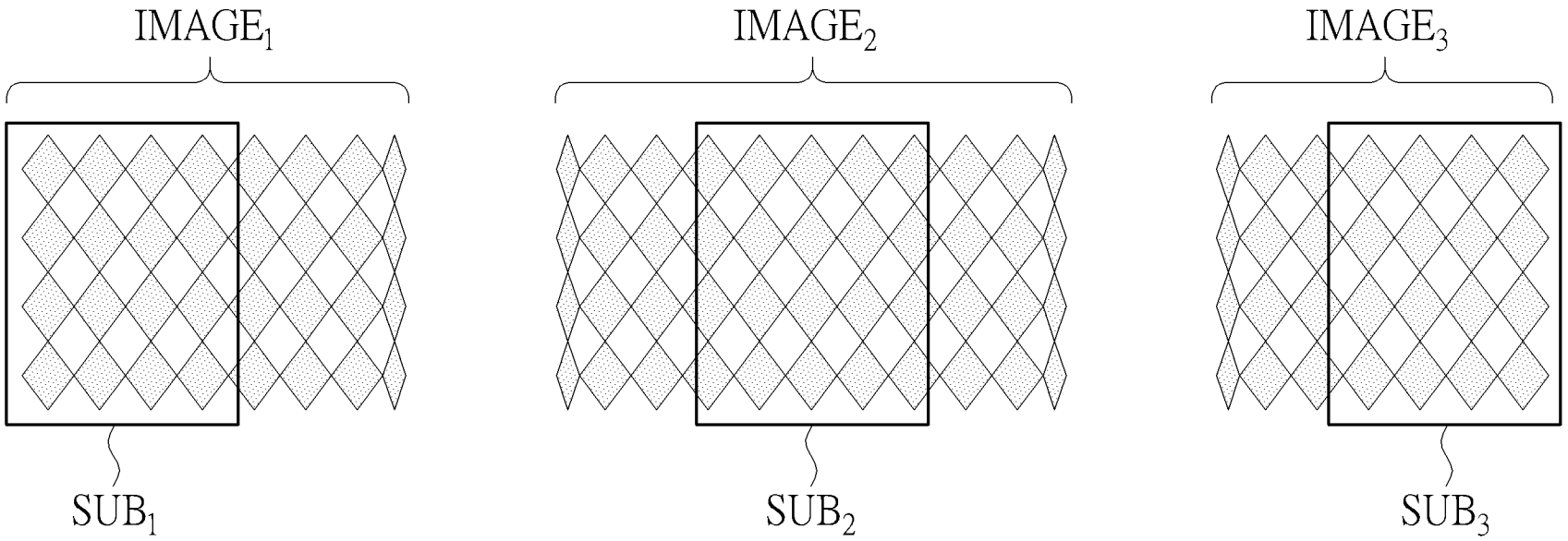

FIGS. 5A and 5B are diagrams illustrating the operation of the Demura system 100 during the image-capturing period according to an embodiment of the present invention. For illustrative purpose, it is assumed that the camera module 20 captures 3 images (M=3) during the image-capturing period, wherein the camera CAM is rotated from left to right and sequentially captures the images $IMAGE_1$~$IMAGE_3$, as depicted in FIG. 5A. Since the camera CAM is confirmed to be located at the predetermined location in the prior calibration operation on camera location, the images $IMAGE_1$~$IMAGE_3$ captured in step 260 have the same resolution, as depicted in FIG. 5B.

Figure 6:
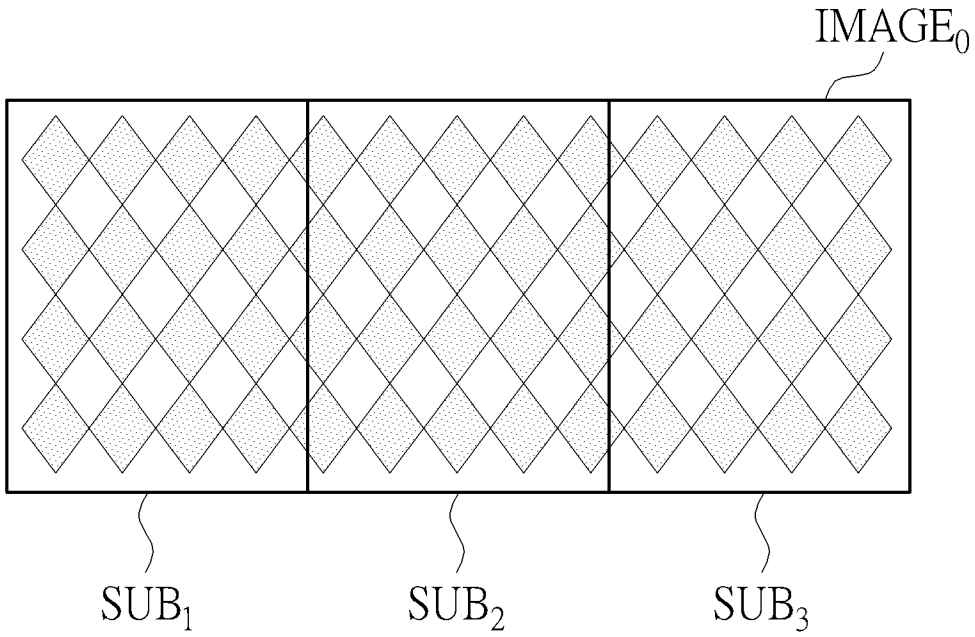
FIG. 6 is a diagram illustrating the operation of a Demura system when performing image composition according to an embodiment of the present invention.

In step 270, the processing circuit 40 is configured to acquire the multiple sub-images $SUB_1$~$SUB_M$ respectively from the multiple images $IMAGE_1$~$IMAGE_M$ and composites the plurality of sub-images $SUB_1$~$SUB_M$ into a planar image for Demura purpose. FIG. 6 is a diagram illustrating the operation of the Demura system 100 when performing image composition according to an embodiment of the present invention. Also assuming M=3, the processing circuit 40 may acquire the sub-images $SUB_1$~$SUB_3$ respectively from the images $IMAGE_1$~$IMAGE_3$ and composite the sub-images $SUB_1$~$SUB_3$ into a planar image $IMAGE_0$. In an embodiment of the present invention, the size of the sub-images $SUB_1$~$SUB_M$ may be determined based on the resolution of the camera CAM and the number of image-capturing (M) during a rotation cycle of the camera CAM.

As previously stated, the image displayed on the non-planar screen 10 may be an initial image which is output with different grey scale conditions. The processing circuit 40 is configured to analyze the difference between the planar image $IMAGE_0$ and the initial image, thereby compensating the Mura of the non-planar screen 10 using an algorithm.

Figure 7:
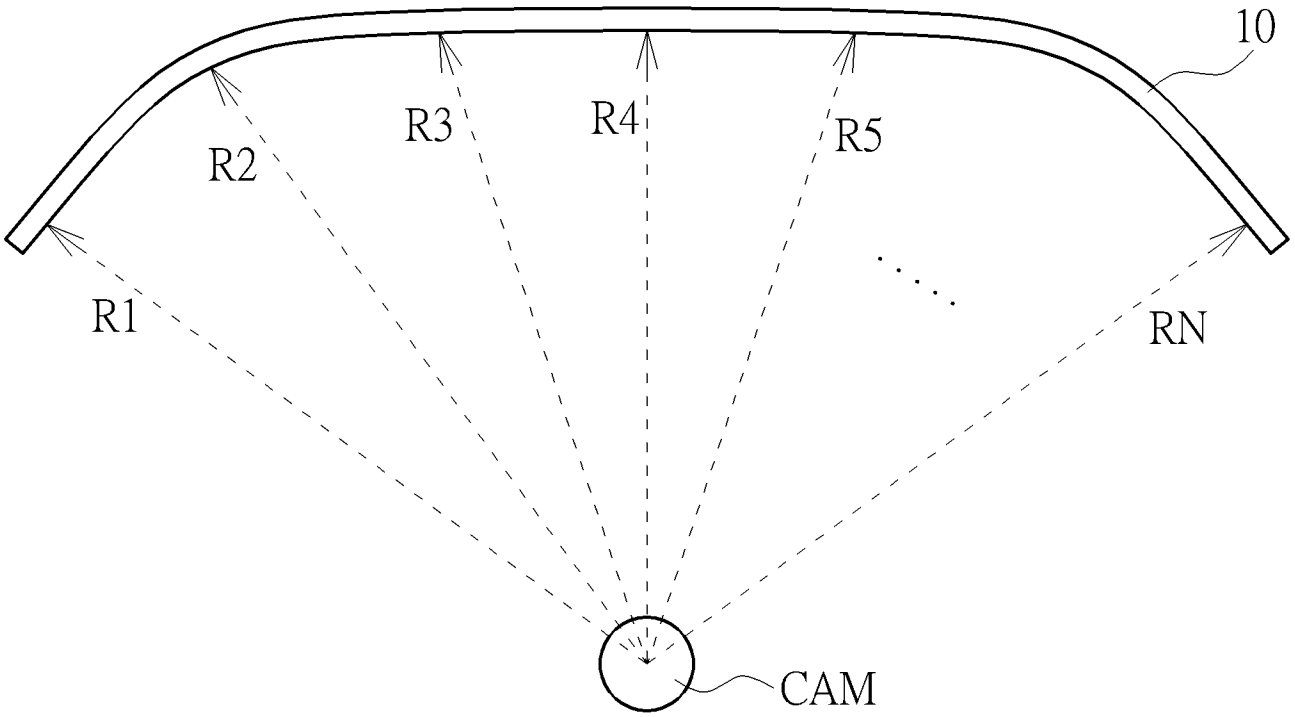
FIG. 7 is a diagram illustrating the operation of a Demura system during the image-capturing period according to another embodiment of the present invention.

FIG. 7 is a diagram illustrating the operation of the Demura system 100 during the image-capturing period according to another embodiment of the present invention. For illustrative purpose, it is assumed that the proximity sensor SR detects the location of the camera SR N times during the test period and the camera module 20 captures N images during the image-capturing period, wherein N is an integer larger than 1. R1~RN represent the data associated with the distance between the camera CAM and the non-planar screen 10 and sequentially acquired by the proximity sensor SR during the test period. When the non-planar screen 10 is a spherical screen or an arc VR screen having distinct curvatures, the lens of the camera CAM may not be at the same distance from the set of all points in the surface of the non-planar screen 10 at the same height of the camera CAM even when the camera CAM is located at the predetermined location ($R1 \neq R2 \neq R3 \neq \ldots \neq RN$). Therefore, in this embodiment, the camera module 20 of the Demura system 100 may include a zoom camera CAM for taking the images $IMAGE_1$~$IMAGE_M$ using a plurality of focuses F1~FN at the distances R1~RN, thereby compensating the variance in curvature of the non-planar screen 10 for allowing the images $IMAGE_1$~$IMAGE_M$ to have the same resolution.

Figure 8:
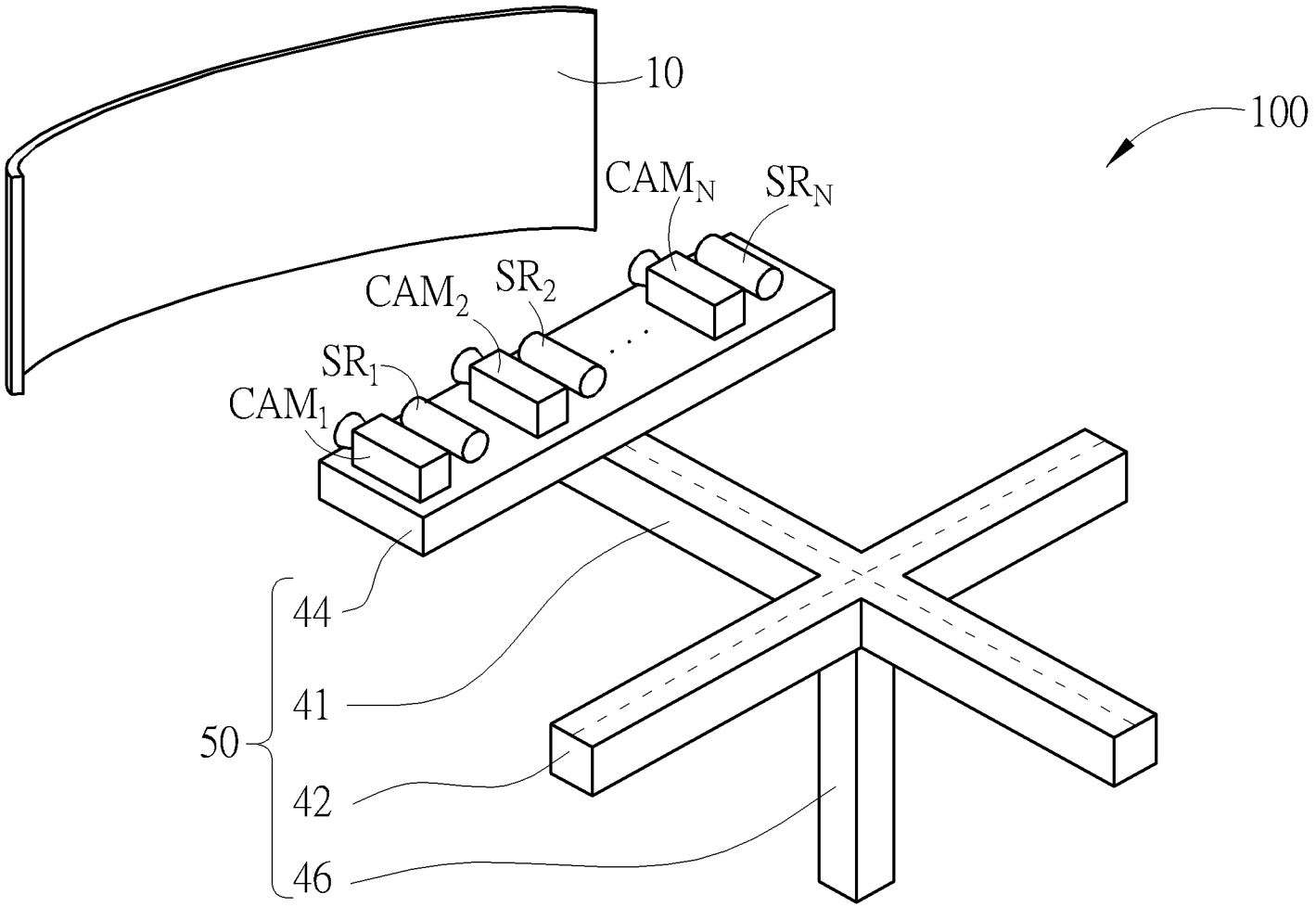
FIG. 8 is a diagram of the Demura system according to another embodiment of the present invention.

FIG. 8 is a diagram of the Demura system 100 according to another embodiment of the present invention. In this embodiment, the non-planar screen 10 is a spherical screen or an arc VR screen having distinct curvatures. The camera module 20 includes multiple cameras $CAM_1$~$CAM_N$ (N is an integer larger than 1) with distinct focuses, and the distance detection module 30 includes multiple proximity sensors $SR_1$~$SR_N$ which may be disposed on the cameras $CAM_1$~$CAM_N$ or adjacent to the cameras $CAM_1$~$CAM_N$, respectively. The location calibration module 50 includes two slide guides 41 and 42, a swiveling base 44, and a pillar 46. The slide guides 41 and 42 provide two tracks perpendicular to each other (represented by dotted lines in FIG. 8), along which an object may move towards or away from the non-planar screen 10, or move from one end of the non-planar screen 10 to another end. The swiveling base 44, disposed on one end of the slide guide 41, is capable of rotating 360 degrees and moving along the tracks of the slide guides 41 and 42. The track of the slide guide 41 and the track of the slide guide 42 cross each other at an intersection point which may be fixed to the pillar 46. The height of the pillar 46 may be adjusted, such as using an electrical air pump. In the Demura system 100 depicted in FIG. 8, the cameras $CAM_1$~$CAM_N$ and the proximity sensors $SR_1$~$SR_N$ may be disposed on the swiveling base 44 of the location calibration module 50, wherein the locations of the cameras $CAM_1$~$CAM_N$ are aligned with the same straight line parallel to a side of the swiveling base 44. The processing circuit 40 (not shown in FIG. 8) may determine whether the current location of the swiveling base 44 deviates from the predetermined location according to the data acquired by the proximity sensors $SR_1$~$SR_N$, wherein the height of the predetermined location is determined based on the height of the non-planar screen 10 or the vertical viewing range of the cameras $CAM_1$~$CAM_N$. When the swiveling base 44 is at the predetermined location, at least one of the cameras $CAM_1$~$CAM_N$ provides the PPD specification which matches that of the non-planar screen 10. In the embodiment illustrated in FIG. 8, the camera module 20 includes multiple cameras $CAM_1$~$CAM_N$ capable of capturing images using distinct focuses, thereby compensating the variance in curvature of the non-planar screen 10 for allowing the images $IMAGE_1$~$IMAGE_M$ to have the same resolution.

Figure 9:
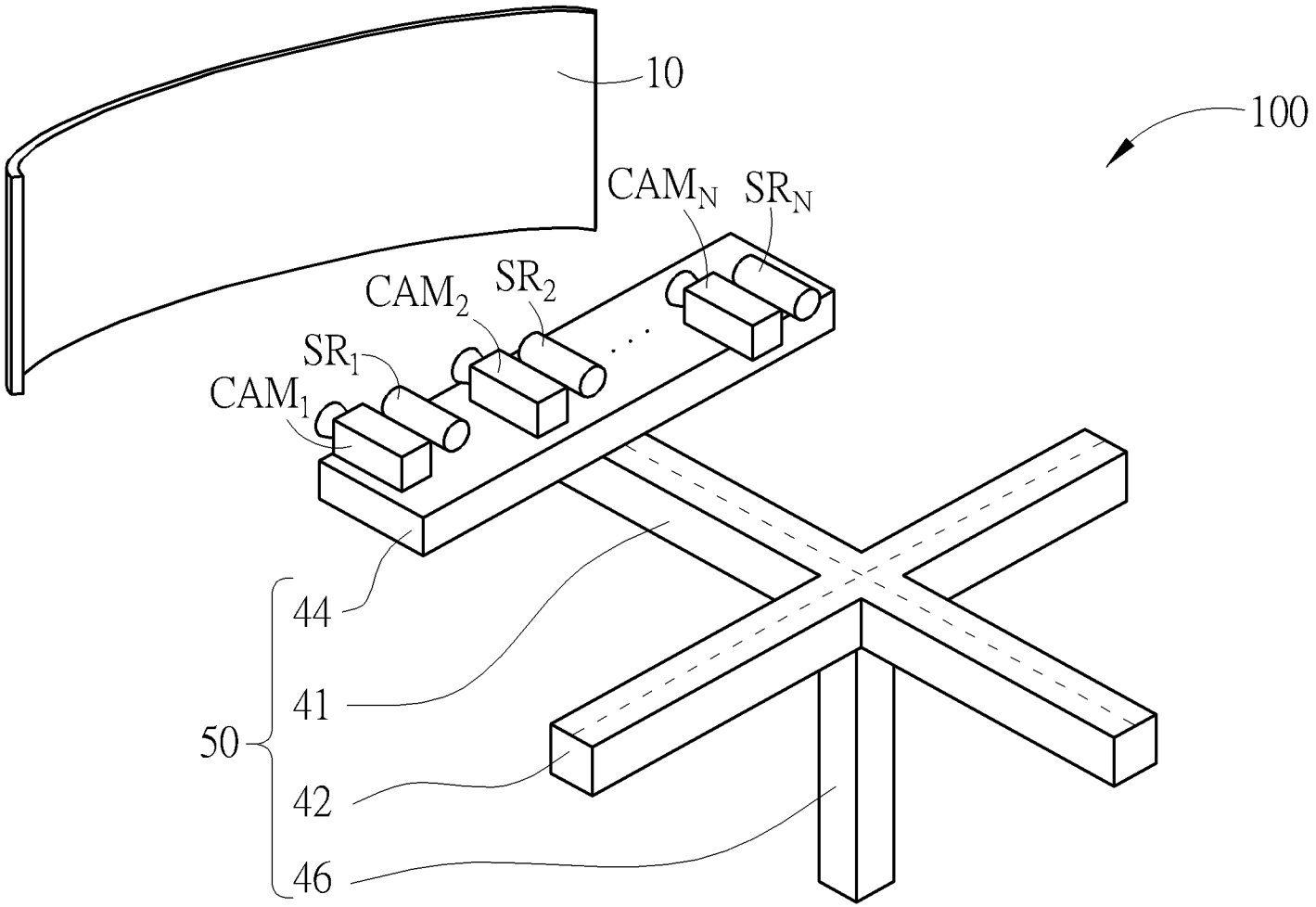
FIG. 9 is a diagram of a Demura system according to another embodiment of the present invention.

FIG. 9 is a diagram of the Demura system 100 according to another embodiment of the present invention. In this embodiment, the non-planar screen 10 is a spherical screen or an arc VR screen having distinct curvatures. The camera module 20 includes multiple cameras $CAM_1$~$CAM_N$ (N is an integer larger than 1) with the same focus, and the distance detection module 30 includes multiple proximity sensors $SR_1$~$SR_N$ which may be disposed on the cameras $CAM_1$~$CAM_N$ or adjacent to the cameras $CAM_1$~$CAM_N$, respectively. The location calibration module 50 includes two slide guides 41 and 42, a swiveling base 44, and a pillar 46. The slide guides 41 and 42 provide two tracks perpendicular to each other (represented by dotted lines in FIG. 9), along which an object may move towards or away from the non-planar screen 10, or move from one end of the non-planar screen 10 to another end. The swiveling base 44, disposed on one end of the slide guide 41, is capable of rotating 360 degrees and moving along the tracks of the slide guides 41 and 42. The track of the slide guide 41 and the track of the slide guide 42 cross each other at an intersection point which may be fixed to the pillar 46. The height of the pillar 46 may be adjusted, such as using an electrical air pump. In the Demura system 100 depicted in FIG. 9, the cameras $CAM_1$~$CAM_N$ and the proximity sensors $SR_1$~$SR_N$ may be disposed on the swiveling base 44 of the location calibration module 50, wherein the locations of the cameras $CAM_1$~$CAM_N$ are aligned with different horizontal straight lines parallel to a side of the swiveling base 44. The processing circuit 40 (not shown in FIG. 9) may determine whether the current location of the swiveling base 44 deviates from the predetermined location according to the data acquired by the proximity sensors $SR_1$~$SR_N$, wherein the height of the predetermined location is determined based on the height of the non-planar screen 10 or the vertical viewing range of the cameras $CAM_1$~$CAM_N$. When the swiveling base 44 is at the predetermined location, at least one of the zoom cameras $CAM_1$~$CAM_N$ provides the PPD specification which matches that of the non-planar screen 10. In the embodiment illustrated in FIG. 9, the camera module 20 includes multiple fixed-focus cameras $CAM_1$~$CAM_N$ located at different distances with respect to the non-planar screen 10 at a given point of time during the image-capturing period, thereby capable of capturing the images $IMAGE_1$~$IMAGE_M$ of different resolutions. At each image-capturing during the image-capturing period, the processing circuit 40 may acquire the sub-images $SUB_1$~$SUB_N$ from one of the images $IMAGE_1$~$IMAGE_M$ captured at each point of time during the image-capturing period and having the specific resolution, thereby compensating the variance in curvature of the non-planar screen 10.

Figure 10:
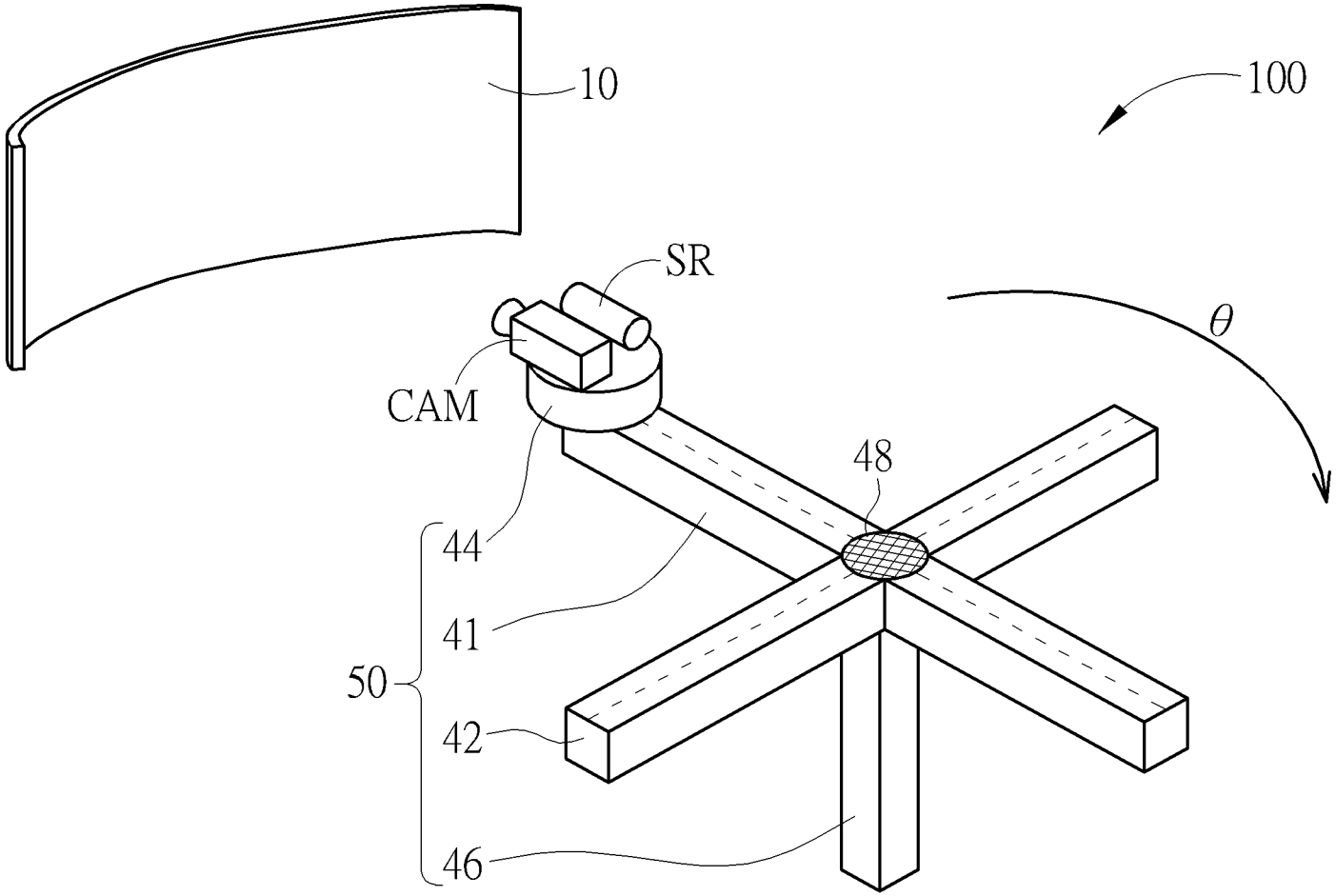
FIG. 10 is a diagram of a Demura system according to another embodiment of the present invention.

FIG. 10 is a diagram of the Demura system 100 according to another embodiment of the present invention. In this embodiment, the non-planar screen 10 is circular-shaped curved screen having a constant curvature. The camera module 20 includes a camera CAM, and the distance detection module 30 includes a proximity sensor SR which may be disposed on the camera CAM or adjacent to the camera CAM. The location calibration module 50 includes two slide guides 41 and 42, a swiveling base 44, and a pillar 46. The slide guides 41 and 42 provide two tracks perpendicular to each other (represented by dotted lines in FIG. 10), along which an object may move towards or away from the non-planar screen 10, or move from one end of the non-planar screen 10 to another end. The track of the slide guide 41 and the track of the slide guide 41 cross each other at an intersection point which includes a pivot structure 48 fixed to the pillar 46. The height of the pillar 46 may be adjusted, such as using an electrical air pump. The slide guides 41 and 42 are pivotally connected to the pillar 48 via the pivot structure 48, thereby capable of rotating around the pillar 46 by an angle of θ degree for adjusting the angle of the swiveling base 44. In the Demura system 100 depicted in FIG. 10, the camera CAM and the proximity sensor SR may be disposed on the swiveling base 44 of the location calibration module 50, and the processing circuit 40 (not shown in FIG. 10) may determine whether the current location of the swiveling base 44 deviates from a predetermined location. Similarly, the Demura system 100 depicted in FIG. 8 or FIG. 9 may also adopt the pivot structure 48 of FIG. 10 for adjusting the angles of the cameras $CAM_1$~$CAM_N$ and the proximity sensors $SR_1$~$SR_N$.

In conclusion, the present invention provides a Demura system for use in a non-planar screen. During the process of capturing the image displayed on the non-planar screen, a camera is rotated so that the distance between the lens of the camera and the non-planar screen may be kept at a constant value. Also, a single zoom camera, multiple cameras with distinct focuses, or multiple cameras with the same focus but disposed at different locations may be used to compensate the variance in curvature of the non-planar screen. Therefore, regardless of the type of the non-planar screen, the present Demura system can keep one or multiple cameras at an appropriate distance and an appropriate angle with respect to the non-planar screen for Mura compensation.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A Demura system, comprising:

a camera module configured to capture an image displayed on a non-planar screen during an image-capturing period;

a distance detection module configured to detect a distance between the camera module and the non-planar screen during a test period;

a location calibration module, comprising:

a first slide guide having a first track along a first direction;

a second slide guide having a second track along a second direction; and a swiveling base disposed at an end of the first slide guide and configured to carry the camera module and the distance detection module, adjust an angle of the distance detection module and an angle of the camera module by rotating, and adjust a location of the camera module by moving along the first track and the second track, wherein:

the first direction is perpendicular to the second direction; and the first track and the second track cross each other at least at an intersection point; and a processing circuit configured to control the location calibration module according to data acquired by the distance detection module during the test period so as to move the camera module to a predetermined location.

2. The Demura system of claim 1, wherein the location calibration module further comprises a pillar with an adjustable height, and the first track and the second track are fixed to the pillar at the intersection point.

3. The Demura system of claim 1, wherein the location calibration module further comprises:

a pillar pivotally connected to the first slide guide and the second slide guide at the intersection point;

and a pivot structure disposed at the intersection point for allowing the first slide guide and the second slide guide to rotate around the pillar, thereby adjusting the angle of the distance detection module and the angle of the camera module.

4. The Demura system of claim 1, wherein:

the non-planar screen has a constant curvature;

the distance detection module includes a proximity sensor; and the processing circuit is further configured to:

instruct the location calibration module to rotate the proximity sensor with a predetermined speed and in a predetermined direction during the test period;

determine whether the location of the camera module deviates from the predetermined location according to the data acquired by the proximity sensor during the test period; and instruct the location calibration module to move the camera module to the predetermined location when determining that the location of the camera module deviates from the predetermined location.

5. The Demura system of claim 1, wherein the distance detection module is disposed on the camera module.

6. The Demura system of claim 1, wherein:

the non-planar screen has a constant curvature; and the processing circuit is further configured to:

instruct the location calibration module to rotate the camera module with a predetermined speed and in a predetermined direction during the image-capturing period;

receive a plurality of images captured by the camera module during the image-capturing period;

acquire a plurality of sub-images from the plurality of images, respectively; and provide a planar image associated with the image displayed on the non-planar screen by compositing the plurality of sub-images.

7. The Demura system of claim 6, wherein the processing circuit is further configured to analyze a difference between the planar image and the image displayed on the non-planar screen, thereby compensating a Mura of the non-planar screen using an algorithm.

8. The Demura system of claim 1, wherein:

the non-planar screen has a plurality of distinct curvatures;

the camera module includes a zoom camera for capturing a plurality of images using a plurality of focuses at a plurality points of time during the image-capturing period, wherein a value of each focus is associated with a corresponding curvature of the non-planar screen at a corresponding point of time so that the plurality of images have a same resolution; and the processing circuit is further configured to:

instruct the location calibration module to rotate the zoom camera with a predetermined speed and in a predetermined direction during the image-capturing period;

receive a plurality of images captured by the camera module during the image-capturing period;

acquire a plurality of sub-images from the plurality of images, respectively; and provide a planar image associated with the image displayed on the non-planar screen by compositing the plurality of sub-images.

9. The Demura system of claim 8, wherein the processing circuit is further configured to analyze a difference between the planar image and the image displayed on the non-planar screen, thereby compensating a Mura of the non-planar screen using an algorithm.

10. The Demura system of claim 1, wherein:

the non-planar screen has a plurality of distinct curvatures;

the camera module includes a plurality cameras for capturing a plurality of images at a plurality points of time during the image-capturing period, wherein the plurality cameras are disposed to aligned with a plurality of straight lines parallel to a side of the swiveling base so that at least one of the plurality of images has a specific resolution; and the processing circuit is further configured to:

instruct the location calibration module to rotate the plurality of cameras with a predetermined speed and in a predetermined direction during the image-capturing period for capturing the plurality of images;

receive the plurality of images captured by each camera;

select one of the plurality of images captured at each point of time as a plurality of sub-images, wherein the plurality of sub-images have the specific resolution; and provide a planar image associated with the image displayed on the non-planar screen by compositing the plurality of sub-images.

11. The Demura system of claim 10, wherein the processing circuit is further configured to analyze a difference between the planar image and the image displayed on the non-planar screen, thereby compensating a Mura of the non-planar screen using an algorithm.

12. A Demura system, comprising:

a camera module configured to capture an image displayed on a non-planar screen having a constant curvature during an image-capturing period;

a distance detection module including a proximity sensor and configured to detect a distance between the camera module and the non-planar screen during a test period;

a location calibration module configured to carry the camera module and the distance detection module, adjust an angle of the distance detection module, adjust an angle of the camera module and adjust a location of the camera module; and a processing circuit configured to:

instruct the location calibration module to rotate the proximity sensor with a predetermined speed and in a predetermined direction during the test period;

determine whether the location of the camera module deviates from a predetermined location according to data acquired by the proximity sensor during the test period; and instruct the location calibration module to move the camera module to the predetermined location when determining that the location of the camera module deviates from the predetermined location.

13. The Demura system of claim 12, wherein the distance detection module is disposed on the camera module.

14. A Demura system, comprising:

a camera module comprising a plurality cameras for capturing a plurality of images displayed on a non-planar screen at a plurality points of time during an image-capturing period, wherein the non-planar screen has a plurality of distinct curvatures, and the plurality cameras are disposed to aligned with a plurality of straight lines parallel to a side of a swiveling base so that at least one of the plurality of images has a specific resolution;

a distance detection module configured to detect a distance between the camera module and the non-planar screen during a test period;

a location calibration module configured to carry the camera module and the distance detection module, adjust an angle of the distance detection module, adjust an angle of the camera module and adjust a location of the camera module; and a processing circuit configured to:

instruct the location calibration module to rotate the plurality of cameras with a predetermined speed and in a predetermined direction during the image-capturing period for capturing the plurality of images;

receive the plurality of images captured by each camera;

select one of the plurality of images captured at each point of time as a plurality of sub-images, wherein the plurality of sub-images have the specific resolution; and provide a planar image associated with the image displayed on the non-planar screen by compositing the plurality of sub-images.

15. The Demura system of claim 14, wherein the processing circuit is further configured to analyze a difference between the planar image and the image displayed on the non-planar screen, thereby compensating a Mura of the non-planar screen using an algorithm.

16. The Demura system of claim 14, wherein the distance detection module is disposed on the camera module.

* * * * *